United States Patent [19]

Agopyan

[11] 4,204,372

[45] May 27, 1980

[54] RETRACTABLE ROOF

[76] Inventor: Berdje Agopyan, 49 Avenue Carnot, Massy, France, 91300

[21] Appl. No.: 922,236

[22] Filed: Jul. 5, 1978

[51] Int. Cl.[2] ..... E04B 1/342

[52] U.S. Cl. ..... 52/64; 52/86

[58] Field of Search ..... 52/64, 63, 68, 66, 71, 52/86, 108, 2; 160/201

[56] References Cited

U.S. PATENT DOCUMENTS

| | | | |
|---|---|---|---|
| 2,692,566 | 10/1954 | Mitchell | 52/63 |
| 2,812,769 | 11/1957 | Schaefer et al. | 52/2 |
| 3,021,896 | 2/1962 | Buono et al. | 160/201 |
| 3,341,180 | 9/1967 | Dashio | 160/201 |
| 3,450,186 | 6/1969 | Caffa et al. | 52/108 |
| 3,461,626 | 8/1969 | Aitken | 52/71 |
| 3,470,659 | 10/1969 | Koning et al. | 52/64 |
| 3,662,410 | 5/1972 | Lankheet | 52/68 |
| 3,708,944 | 1/1973 | Miyake | 52/86 |
| 4,027,440 | 6/1977 | Hamblin | 52/108 |

FOREIGN PATENT DOCUMENTS

| | | | |
|---|---|---|---|
| 772349 | 11/1967 | Canada | 52/66 |
| 955651 | 1/1950 | France | 52/2 |

*Primary Examiner*—James L. Ridgill, Jr.

*Attorney, Agent, or Firm*—Browdy and Neimark

[57] ABSTRACT

A removable roof capable of being removed in whole or in part which is made up of a self-supporting structure supported on the ground; a series of movable elements connected to the structure and constituting the roof itself, these elements being capable of removal and stacking or storage at ground level or below and means for receiving the movable elements.

6 Claims, 11 Drawing Figures

RETRACTABLE ROOF

FIELD OF THE INVENTION

This invention relates to the building field and, more particularly to a new removable and retractable roof system.

BACKGROUND OF THE INVENTION

For a number of years removable roof units have been made which are used, for example, for the construction of winter-summer swimming pools. Generally, the roof, supported by pillars or poles during the cold season, is transferred in summer onto another series of poles installed permanently beside the previous ones. According to a variant embodiment, the roof is made up of arc-shaped panels made to pivot by a turning movement around a central mast, the unit traveling on a rail. Both of these systems exhibit a certain number of drawbacks both on the aesthetic and technical and technical plane; for example, the need of a double carrying structure in the first case, and, in the second case, the constant presence on the roof of at least a panel or section of panels under which the other panels fold. Further, in these known techniques, the dimensions are limited and removable roofs with a very large surface, for example, more than 1000 $m^2$, cannot be realized.

SUMMARY OF THE INVENTION

The present invention makes it possible to eliminate these drawbacks and to solve the problem of designing large span covers able to be retracted completely in a very short time without requiring auxiliary support elements that are offensive to aesthetics and very costly. Further, it makes possible very large size roofs, practically without maximum load limit.

The new roof according to the present invention is essentially made up of the combination of (a) a self-supporting structure, with support points on the ground; (b) a series of movable elements connected to said structure and able to fold on one another or disappear entirely at the ground level or below; (c) means intended to receive said movable elements.

The self-supporting structure can be either stationary and of a single piece or made of several elements, telescopic or not. In the first case, it remains in place after disappearance of the movable elements that constitute the roof itself. In the second case, it is possible to eliminate it partly or wholly, from its installation site, which can be of interest, for example, for aviation hangars, strategic or other, or again for buildings that are temporary or are to be erected later in other places. This self-supporting structure can have any configuration, for example, curved, helicoidal or other, and be made of various materials such as tubular concrete, prestressed concrete, metal or metal alloy, laminated sheets, etc. In practice, it is often advantageous to provide a hollow structure so as to be able to house the units and devices corresponding to the technical utilities such as lighting, ventilation systems, and the like. Further, this self-supporting frame is provided with means making it possible for the movable elements to glide or slide when they are folded or made to disappear. For example, these means can be rails or slides that work with the rolling elements or the roller or other type provided on the ends of the movable elements.

The movable elements according to the present invention are made up of a series of panels that, during use as a cover, are made solid with one another and fluid-tight and that, during the covering or uncovering stage, can be translated or slide on one another and can be superposed. In practice, these panels can assume various shapes as, for example, flat elements, composite beams, shells that are curved like airplane wings, truncated or cylindrical, etc. According to an advantageous embodiment, these panels are filled with cellular material such as plastic foam injected to assure good sound and heat insulation. The constitutive materials can be chosen from the range of known products such as metals or alloys (for example, anodized aluminum), plastic mineral fiber laminates, lightweight concrete, etc. Such perfectly insulated panels can be suitable, with proper equipment, for the recovery and transformation of solar energy. According to a variant, the panels can be made of canvas or the like or again of inflatable structures. Finally,, these removable elements can be provided, depending on need, with portholes, doors or various other accessories as desired.

The means for receiving the movable panels, during the roof removal, can be of several types. According to a first embodiment, the panels are stacked or superposed in one or more trenches located in the proximity of the side parts, for example, on each side of the building. According to another embodiment, there is provided at ground level or below ground a hollow area, with a surface fairly equivalent to that occupied by the roof, so as to permit, by rotation of the solid movable elements, a translation of these latter into this hollow area. Such an embodiment is particularly suitable when the ground opened by the building with the removable roof comprises a series of steps, the hollow area then being able to be provided between the ground and the base of the steps. According to a variant, the panels can fold like a fan, similar to slatted shutters, on one side of the self-supporting structure.

BRIEF DESCRIPTION OF THE DRAWINGS

The invention will be better understood from the detailed description of an embodiment, given by way of non-limiting example, with reference to the figures of the accompanying drawings which schematically represent.

DESCRIPTION OF PREFERRED EMBODIMENTS

Figure 1:
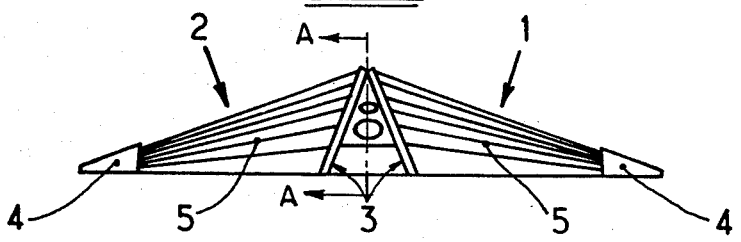
FIGS. 1 and 2 are front and plan views, respectively, of a construction with a removable roof according to the invention.
Figure 2:
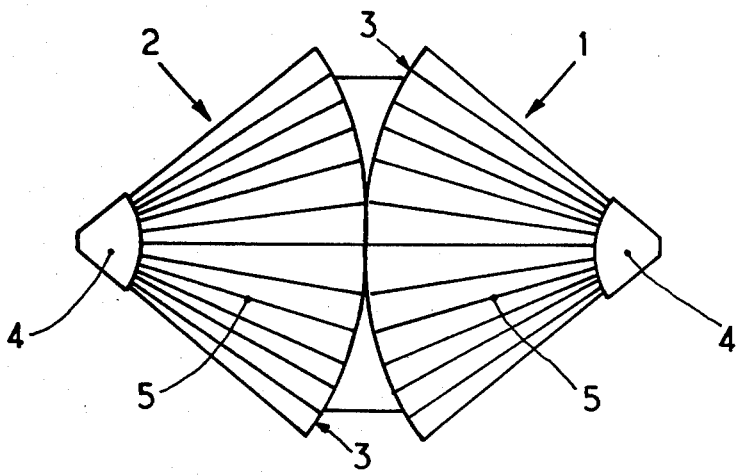
Figure 3:
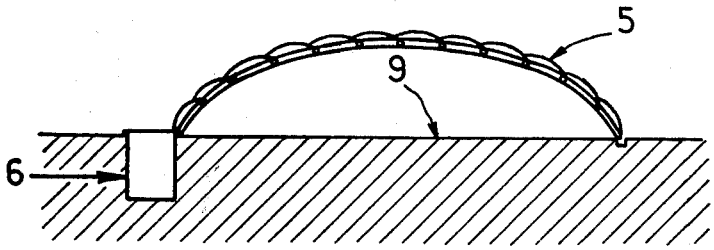
FIGS. 3 and 4 are cross sectional views along AA of FIG. 1, showing the respective positions of the closed roof (FIG. 3) and open roof (FIG. 4), with a trench for recovery of the removable elements.
Figure 4:
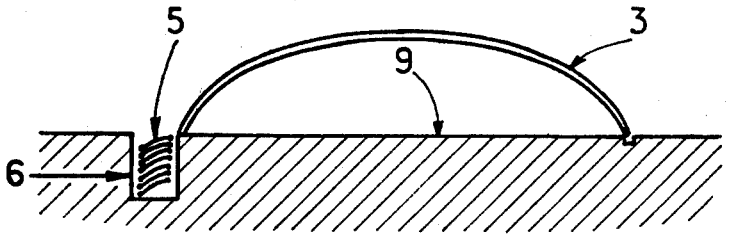

As shown in the figures by way of example of embodiment, the building with a removable roof according to the present invention has a general curved appearance and assumes the configuration of two truncated conical sections 1 and 2 (FIGS. 1 and 2). It essentially comprises: a self-supporting structure made up here, in the upper part, of a double beam 3 of actuate shape and in the lower part of a double beam 4 either similar to or constituting the vertex of the cone; a series of movable elements 5 connected to the structure (3, 4) and capable of being removed entirely as will be explained below; an area for receiving the movable elements or panels, which, for example, can be a trench 6 (FIGS. 3, 4 and 5) or an open space 7 arranged under the stairs 8 (see FIG. 9) when the ground 9 to be covered comprises such elements.

Here movable elements 5 constitute shells and can be formed as caissons with internal ribs, for example, of sheets of anodized aluminum or other material. The inside of the caissons is preferably filled with an insulating plastic foam. Shells 5, with great resistance to stress and loads, are solid with one another in the closed roof position (see FIG. 3) and can be retracted by sliding or rolling on one another to stack in trench 6 leaving the self-supporting structure 3 in the open air (see FIG. 4).

Figure 6:
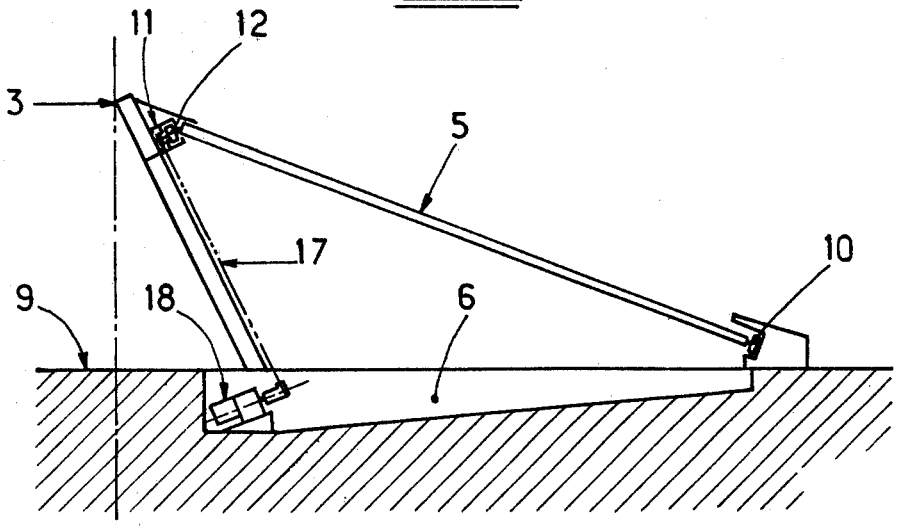
FIG. 6 is a partial view showing a method of connecting the movable elements with the self-supporting structure of the roof and of moving these elements into the trench.
Figure 7:
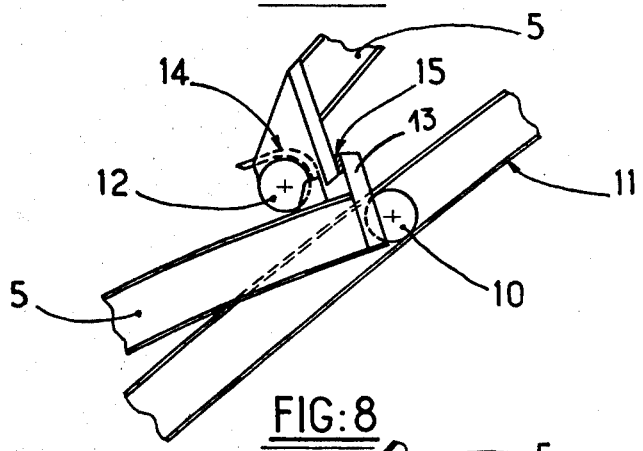
FIGS. 7 and 8 are views of detail of assembly of two movable elements or panels and their disconnection, in the respective positions: closed roof (FIG. 7) and roof in opening position (FIG. 8)
Figure 8:
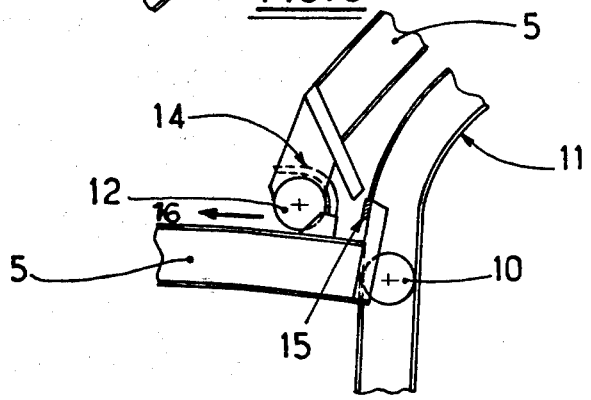

According to the embodiment shown in FIGS. 6 and 8, each shell 5 contains a rolling system, for example a roller 10, guided in a rail 11 supported by the self-supporting structure (3, 4) and a roller 12 resting on the adjacent element and which permits rolling of the shells on one another during stacking in the trench 6 or other storage area. Elements 5 are solid with one another due to anchor rods 13 and cams 14 and are connected by fluid tight joints 15. These parts can be clearly seen in FIGS. 7 and 8, respectively, in the interlocking position, the roof closed, and in the uncovered position according to arrow 16 in the phase of opening and stacking of shells 5.

Figure 5:
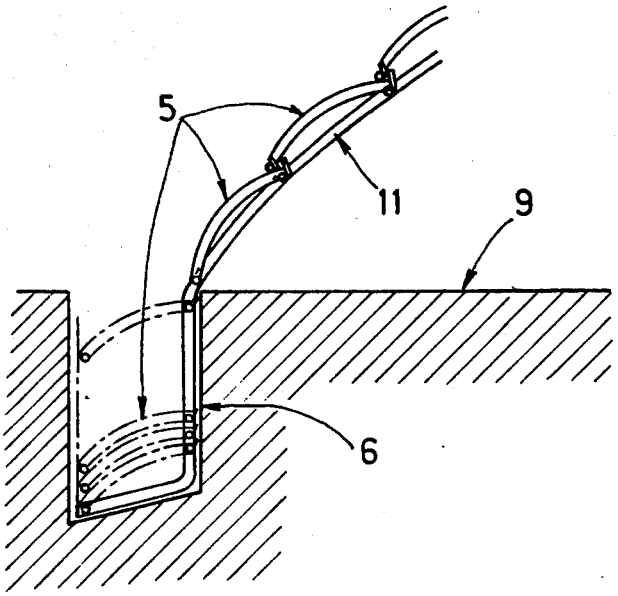
FIG. 5 is a detail showing a method of stacking the movable elements in a trench.

A device for controlling the movement of the movable elements 5 is shown in FIG. 6. Opening and closing of the roof are controlled here by a cable 17 (or rack bar), fastened to the first shell 5 to be retracted and operated by a winch 18, electric or otherwise, placed, for example, in trench 6. Due to the rollers (10, 12), the first shell, thus removed by the cable, draws the following shells which then roll on one another and stack in trench 6 as shown in FIG. 5. Of course, any operating means other than those cited can be used for uncovering the roof.

Figure 9:
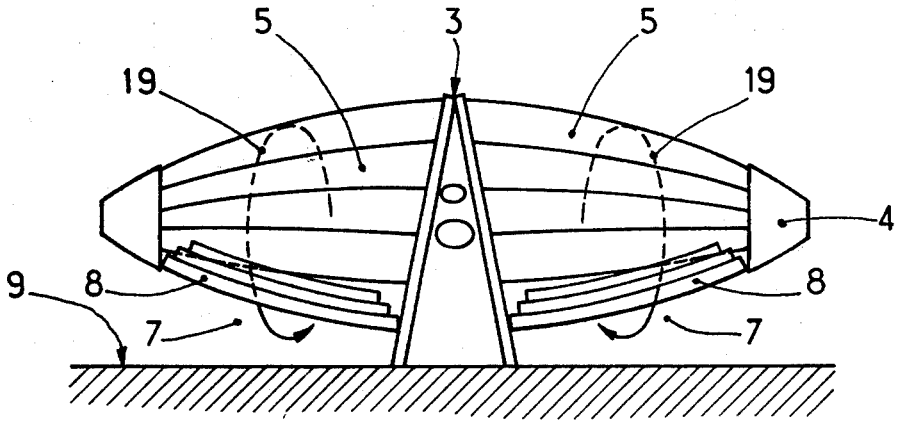
FIG. 9 shows a variant embodiment in which the removable panels are translated, in open position, under the area originally covered by the structure, for example, under the steps.

According to the variant of FIG. 9, which considers, for example, the case of a play area provided with steps 8 on its periphery, the unit of movable panels 5, on each side of the self-supporting structures (3, 4), is translated according to arrow 19 into area 7 available between the steps 8 and ground 9. Thus, during opening, the entire roof can disappear under the building by using approximately the same developed surface as the building.

Figure 10:
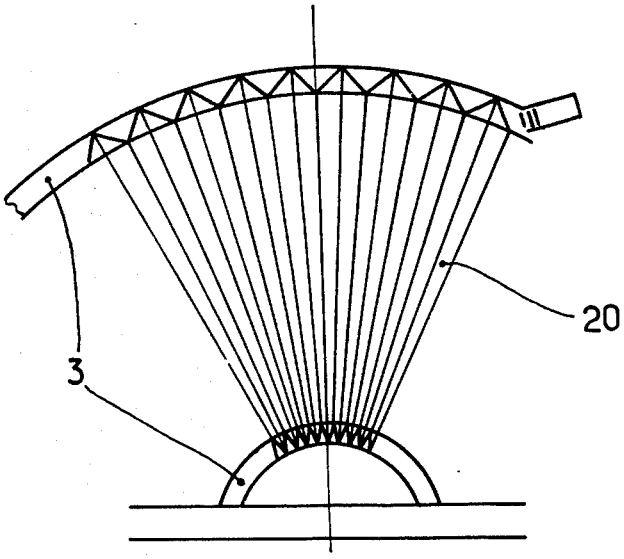
FIGS. 10 and 11 show another embodiment according to which the panels can be unfolded and later folded as articulated shutters.
Figure 11:
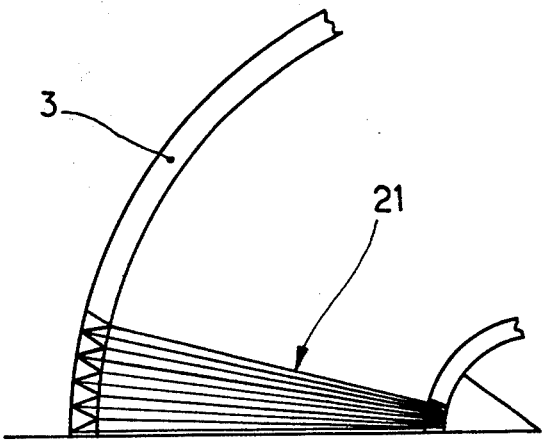

According to the embodiment shown in FIGS. 10 and 11, the plane or shaped panels can be made of elements articulated in the form of shutters that are either unfolded as indicated by 20 during covering of the frame 3 or folded on one another as indicated at 21, such a folding being accomplished on one side of the frame instead of being stacked in a trench as in the mode of construction shown in FIG. 5.

As explained above, the self-supporting structure 3 can itself be made of removable elements, for example, of the telescopic type. Further, numerous other variants can be used without going outside the scope of the invention, as delimited particularly by the following claims.

What is claimed is:

1. A building structure having a roof which can be retracted, the structure comprising a self-supporting frame structure having at least one circular, arc-shaped beam fixed at its respective ends with its mid-point uppermost, and at least one fixed support beam shorter than said arc-shaped beam positioned at a point in a substantially vertical plane passing through said mid-point and at substantially equal distances from said ends, each of said beams having respective means thereon to support mobile roofing members; a plurality of said mobile roofing members extending between said beams, said mobile roofing members being retractable over a respective adjacent lower said roofing member in a fan-like manner to completely open the roof; and storage means for receiving and holding said roofing members when completely retracted, said members when completely retracted being out of sight from inside the building structure.

2. A building structure according to claim 1, wherein said movable roofing members each comprise a system of connection by rolling, with adjacent respective said roofing members to permit movement of said members during opening of the roof.

3. A building structure according to claim 1, wherein said movable roofing members are articulated panels capable of folding as fan-like shutters, on one side of said self-supporting structure.

4. A building structure according to claim 1, wherein said storage means for receiving said movable roofing members is a trench provided in the vicinity of a side of said self-supporting frame structure, said trench being between an end of said arc-shaped beam and said fixed support beam.

5. A building structure according to claim 1, wherein said storage means for receiving said movable roofing members is a hollow space provided at ground level or below and having a volume substantially equal to that occupied by the roof.

6. A building structure according to claim 1, wherein said at least one circular arc-shaped beam comprises two circular arc-shaped beams having their respective ends fixed and with their respective mid-points uppermost and adjacent one another; wherein said at least one fixed support beam comprises two fixed support beams spaced from one another and positioned at respective points in a substantially vertical plane passing through said mid-points and substantially equal distances from ends of respective said circular arc-shaped beams; wherein all of said beams have respective means thereon to support mobile roofing members, wherein a first group of said plurality of roofing members is supported between one of said circular arc-shaped beams and one of said fixed support beams and a second group of said plurality of roofing members is supported between the other of said circular arc-shaped beam and the other of said fixed support beams, said first and second groups of said mobile members being retractable in a fan-like manner; and wherein said storage means includes distinct means for receiving and holding respectively roofing members of said first group and said second group.

* * * * *